US011111886B1

(12) United States Patent
Fujihira et al.

(10) Patent No.: US 11,111,886 B1
(45) Date of Patent: Sep. 7, 2021

(54) EGR SYSTEM OF ENGINE

(71) Applicant: Mazda Motor Corporation, Hiroshima (JP)

(72) Inventors: Shinji Fujihira, Aki-gun (JP); Hiroshi Kinoshita, Aki-gun (JP); Takashi Kariya, Aki-gun (JP); Takayuki Tominaga, Aki-gun (JP); Ken Yoshida, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/177,464

(22) Filed: Feb. 17, 2021

(30) Foreign Application Priority Data

Apr. 1, 2020 (JP) ..... JP2020-065765

(51) Int. Cl.

| | |
|---|---|
| ***F02M 26/23*** | (2016.01) |
| ***F02M 26/21*** | (2016.01) |
| ***F02D 41/14*** | (2006.01) |
| ***F02D 41/00*** | (2006.01) |
| ***F02M 26/41*** | (2016.01) |

(52) U.S. Cl.
CPC ..... *F02M 26/23* (2016.02); *F02D 41/0052* (2013.01); *F02D 41/0077* (2013.01); *F02D 41/1454* (2013.01); *F02M 26/21* (2016.02); *F02M 26/41* (2016.02)

(58) Field of Classification Search
CPC ..... F02M 26/23; F02M 26/21; F02M 26/41; F02D 41/1454; F02D 41/0052; F02D 41/0077
See application file for complete search history.

(56) References Cited

U.S. PATENT DOCUMENTS

2011/0315129 A1* 12/2011 Kojima ..... F02M 26/19 123/568.12
2016/0186704 A1* 6/2016 Murotani ..... F02M 26/28 123/568.12
2017/0276095 A1* 9/2017 Beyer ..... F02M 26/30
2018/0030876 A1* 2/2018 Miyoshi ..... F01N 13/1811

FOREIGN PATENT DOCUMENTS

JP 2016102429 A 6/2016

* cited by examiner

*Primary Examiner* — Xiao En Mo

(74) *Attorney, Agent, or Firm* — Alleman Hall Creasman & Tuttle LLP

(57) ABSTRACT

An engine EGR system is provided. An EGR passage includes an EGR cooler, an EGR internal passage passing through a cylinder head on an upstream side of the EGR cooler, and a relay passage extending outside the cylinder head and connecting the EGR internal passage to the EGR cooler. The EGR cooler formed in a columnar shape is arranged above an intake manifold so as to locate a gas inflow port on a first end surface side and a gas outflow port on a second end surface side, and the relay passage communicates with the EGR internal passage on an external side of the engine compared to a head EGR gas exit. The EGR cooler inclines downward from the gas outflow port toward the gas inflow port, and the relay passage is connected to the gas inflow port while being bent downward toward the upstream side.

20 Claims, 8 Drawing Sheets

EGR SYSTEM OF ENGINE

TECHNICAL FIELD

The present disclosure relates to an exhaust gas recirculation (EGR) system of an engine.

BACKGROUND OF THE DISCLOSURE

There is known a technology for engines for driving a vehicle, etc., that brings a portion of exhaust gas (also referred to as EGR gas) back into intake gas, so-called EGR (Exhaust Gas Recirculation). A majority of EGR systems that perform EGR are usually installed with an EGR cooler to cool high-temperature EGR gas.

Regarding the disclosed technology, JP2016-102429A discloses an engine in which an EGR cooler is disposed on an upper part of an intake manifold.

Condensed water containing oxidizing substances is generated inside the EGR cooler. Therefore, when the EGR cooler is placed transversely as in the engine of JP2016-102429A, it is preferred to avoid the condensed water from accumulating in the EGR cooler. For this, a considerable general method is to tilt the EGR cooler and flow the condensed water down.

However, the engine is installed in a limited space of an engine bay. Moreover, when the EGR cooler is disposed on the upper part of the intake manifold as in the engine of JP2016-102429A, a gap formed between the EGR cooler and a bonnet covering an upper part of the EGR cooler becomes narrow. This gap needs to have a given size in order for the bonnet to deform at the time of a collision and mitigate its impact.

On the other hand, in order to tilt the transversely placed EGR cooler so that the condensed water flows down, one of end parts of the EGR cooler needs to be greatly lifted. In this case, it becomes difficult to secure the at least given size of gap. For this reason, it is not easy to improve a drainage property of condensed water by simply tilting the EGR cooler. Therefore, a layout of the overall EGR system has been reviewed in order to secure the gap between the engine and the bonnet and to improve the drainage property of the EGR cooler placed transversely on the engine.

SUMMARY OF THE DISCLOSURE

The present disclosure is made in view of the above situation, and one purpose thereof is to provide an exhaust gas recirculation (EGR) system of an engine, which improves a drainage property of an EGR cooler of the EGR system without losing its cooling performance, while reducing an overall height of the EGR system.

According to one aspect of the present disclosure, an EGR system of an engine is provided, which includes an engine body including a cylinder head provided in an upper part of the engine body and forming a plurality of combustion chambers in which combustion is performed, a first end surface, and a second end surface, the plurality of combustion chambers being lined up between the first end surface and the second end surface. The system includes an intake passage configured to introduce intake air into each of the plurality of combustion chambers via an intake manifold attached to the cylinder head, an exhaust passage connected to the cylinder head and through which exhaust gas is discharged from the combustion chambers, and an EGR passage connecting the exhaust passage to the intake passage and configured to recirculate the exhaust gas as EGR gas to the intake passage.

The EGR passage includes an EGR cooler configured to cool the EGR gas while the EGR gas flows from a gas inflow port to a gas outflow port, an EGR internal passage passing through the cylinder head, on an upstream side of the EGR cooler, and a relay passage extending outside the cylinder head and connecting the EGR internal passage to the EGR cooler. The cylinder head is formed in the first end surface with a head EGR gas exit from which the EGR gas is discharged after passing through the cylinder head.

The EGR cooler is formed in a columnar shape having the gas inflow port at one end side in a longitudinal direction and the gas outflow port at the other end side in the longitudinal direction, and is arranged above the intake manifold so as to locate the gas inflow port on the first end surface side and the gas outflow port on the second end surface side, the relay passage communicating with the EGR internal passage, on an external side of the engine compared to the head EGR gas exit.

The EGR cooler inclines downward from the gas outflow port toward the gas inflow port, and the relay passage is connected to the gas inflow port while being bent downward toward the upstream side.

According to this engine EGR system, the EGR passage includes the EGR cooler, which can cool the EGR gas. The EGR passage further includes the EGR internal passage passing through the cylinder head, on the upstream side of the EGR cooler. Normally, a water-cooling passage configured to cool the combustion chambers is formed in the cylinder head. By the heat exchange with the cooling water flowing in the water-cooling passage, the EGR gas flowing in the EGR internal passage can be cooled. Therefore, the EGR gas is effectively cooled.

The EGR cooler is formed in a columnar shape extending in a direction in which the EGR gas flows (gas flow direction). By having its entire length longer, the cooling performance of the EGR cooler is secured even when its vertical width is reduced. While the vertical width of the EGR cooler is reduced, its height is reduced.

The EGR cooler is arranged so as to extend in the longitudinal direction of the cylinder head in a state where its orientation is matched with the gas flow direction. Thereby, the smooth inflow and outflow of the EGR gas are ensured, and the height of the EGR cooler is reduced so as to be within the entire length range of the cylinder head.

The relay passage is connected to communicate with the EGR internal passage, on the external side of the end surface of the cylinder head. That is, the cylinder head is provided in the first end surface with the exit from which the EGR gas is discharged after passing through the cylinder head (head EGR gas exit). The relay passage communicates with the EGR internal passage on further outward from the head EGR gas exit. By connecting the relay passage at a position externally away from the first end surface, a distance to the EGR cooler increases, and the relay passage is extended.

Further, the EGR cooler inclines downward from the gas outflow port toward the gas inflow port. Since the EGR cooler is long in the gas flow direction, the condensed water generated by the EGR cooler smoothly flows to the upstream side even if the inclination is gentle. In addition, the condensed water is prevented from entering the downstream side where an EGR valve is located.

Further, the relay passage is connected to the gas inflow port while being bent downward toward the upstream. When a large amount of EGR gas flows through the EGR passage, a channel cross section of the relay passage is desirably large, and a channel resistance of the relay passage is desirably small. Therefore, it is desirable that the relay passage is constituted by a pipe having a large diameter and bent in the gas flow direction, and both end parts of the relay passage are smoothly connected.

However, when the diameter becomes large, a degree of bend cannot be large and a radius of curvature becomes large. Regarding this, in this structure, the relay passage is connected at the position outward from the end surface of the cylinder head. Therefore, the distance to the gas inflow port becomes long.

Thus, the entire length of the relay passage becomes long, and the relay passage having a large pipe diameter and a large radius of curvature is structured. The both end parts of the relay passage are smoothly connected in a state where the relay passage is bent downward toward the upstream. As a result, a large amount of EGR gas smoothly flows, and condensed water which flows down to the relay passage from the EGR cooler is smoothly discharged. Therefore, while the overall EGR system including the EGR cooler is reduced in its height, a drainage property of the EGR cooler is improved without losing its cooling performance.

The EGR system may further include a first attachment member attached to the first end surface, the first attachment member including an extension passage located on the external side of the engine compared to the first end surface and constituting the EGR internal passage. The relay passage may be connected to the first attachment member to communicate with the extension passage.

According to this structure, the first attachment member including the extension passage constituting the EGR internal passage is attached to the first end surface of the cylinder head. With this first attachment member, the EGR internal passage is extended from the first end surface of the cylinder head to the position outward from the first end surface. Therefore, by forming the water-cooling passage also in the first attachment member, heat is exchanged with the cooling water, and the EGR gas is effectively cooled.

Since the relay passage is connected to the first attachment member to communicate with the extension passage, the distance to the gas inflow port can be long as described above. Therefore, the large amount of EGR gas smoothly flows, and the drainage property of the EGR cooler is improved.

The EGR passage may further include an EGR valve configured to adjust a flow rate of the EGR gas. The EGR valve may be disposed downstream of the EGR cooler via a connecting passage connected to the gas outflow port. The EGR valve may be directly fixed to an upper part of the intake manifold, and the connecting passage may pass the upper side of the EGR valve, extend toward the second end surface, and be connected to an upper part of the EGR valve.

That is, a layout of the downstream part of the EGR cooler in the EGR passage is also devised. By directly fixing the EGR valve to the intake manifold, the supporting strength of the EGR valve increases and a swaying movement of the EGR valve is reduced. The height of the EGR valve is also reduced.

The connecting passage which connects between the EGR valve and the EGR cooler may be connected to the upper part of the EGR valve in a state where it passes the upper side of the EGR valve to extend toward the second end surface. Therefore, even with the connecting passage of the laterally long shape, the connecting passage is arrangeable without projecting outwardly from the second end surface of the cylinder head. As a result, the entire engine including the EGR system is efficiently disposed in an engine bay.

The EGR cooler may be arranged to incline in a lateral direction and the relay passage may be arranged to incline in a vertical direction so that the gas outflow port is located away from the cylinder head compared to the gas inflow port.

According to this structure, the EGR cooler is also arranged to incline in a lateral direction. In detail, the EGR cooler is arranged to incline so that the gas outflow port is located away from the cylinder head than the gas inflow port when seen vertically.

Accordingly, the relay passage is also arranged to incline in a vertical direction. In detail, the relay passage is arranged to incline to the up-and-down direction so that the upstream side is located away from the gas inflow port than the downstream side, when seen in the left-and-right direction. Thus, the EGR cooler and the relay passage become even longer. Therefore, while having an efficient arrangement in a compact space, a smooth flow of EGR gas and a smooth discharge of condensed water are achieved.

The EGR system may further include a second attachment member disposed near the first end surface of the cylinder head, the second attachment member being disposed in a space formed below the EGR cooler and the relay passage.

According to this structure, the portion of the EGR passage including the EGR cooler and the relay passage is arranged to pass the upper side of the intake manifold and extend toward the first end surface of the cylinder head. In such a case, a certain size of space is created below the EGR cooler and the relay passage.

Since the second attachment member is disposed in this space, the second attachment member is effectively disposed in a space efficient manner, and thus, dead space is not created.

When the engine operates in a high load range including a full load, the engine may perform combustion with a stoichiometric air-fuel ratio as a target value.

Normally when the engine operates in the high load range, a combustion temperature rises and abnormal combustion occurs. Therefore, the amount of fuel is increased and latent heat of vaporization of the fuel is used to cool mixture gas in order to avoid abnormal combustion. However, in this control, the fuel amount increases and therefore fuel efficiency degrades.

Meanwhile, when performing combustion at the stoichiometric air-fuel ratio, fuel efficiency is improved, but abnormal combustion cannot be avoided because the latent heat of vaporization cannot be used. If the circulation amount of the EGR gas is increased in this case, an oxygen concentration of the intake air decreases, and thus the abnormal combustion can be avoided. However, by performing the combustion at the stoichiometric air-fuel ratio, the temperature of the exhaust gas increases.

Therefore, when the engine operates in the high load range, if performing the combustion at the stoichiometric air-fuel ratio while the circulation amount of the EGR gas is increased to avoid abnormal combustion, the EGR gas is recirculated at a higher temperature and in a larger amount compared to a conventional example. The heat amount of the EGR gas becomes excessive with respect to performance of the EGR cooler, and thus the durability of the EGR cooler degrades.

In this regard, according to this engine EGR system, as described above, the excess heat of the EGR gas flowing into the EGR cooler can be removed effectively. Therefore, even when the high temperature and large amount of EGR gas is recirculated, the heat amount of the EGR gas can be suppressed from becoming excessive with respect to the performance of the EGR cooler. As a result, fuel efficiency improves.

DETAILED DESCRIPTION OF THE DISCLOSURE

Hereinafter, one embodiment of a present disclosure is described. Note that the following description is merely an example and is not to limit the present invention, its application, or its use.

Figure 1:
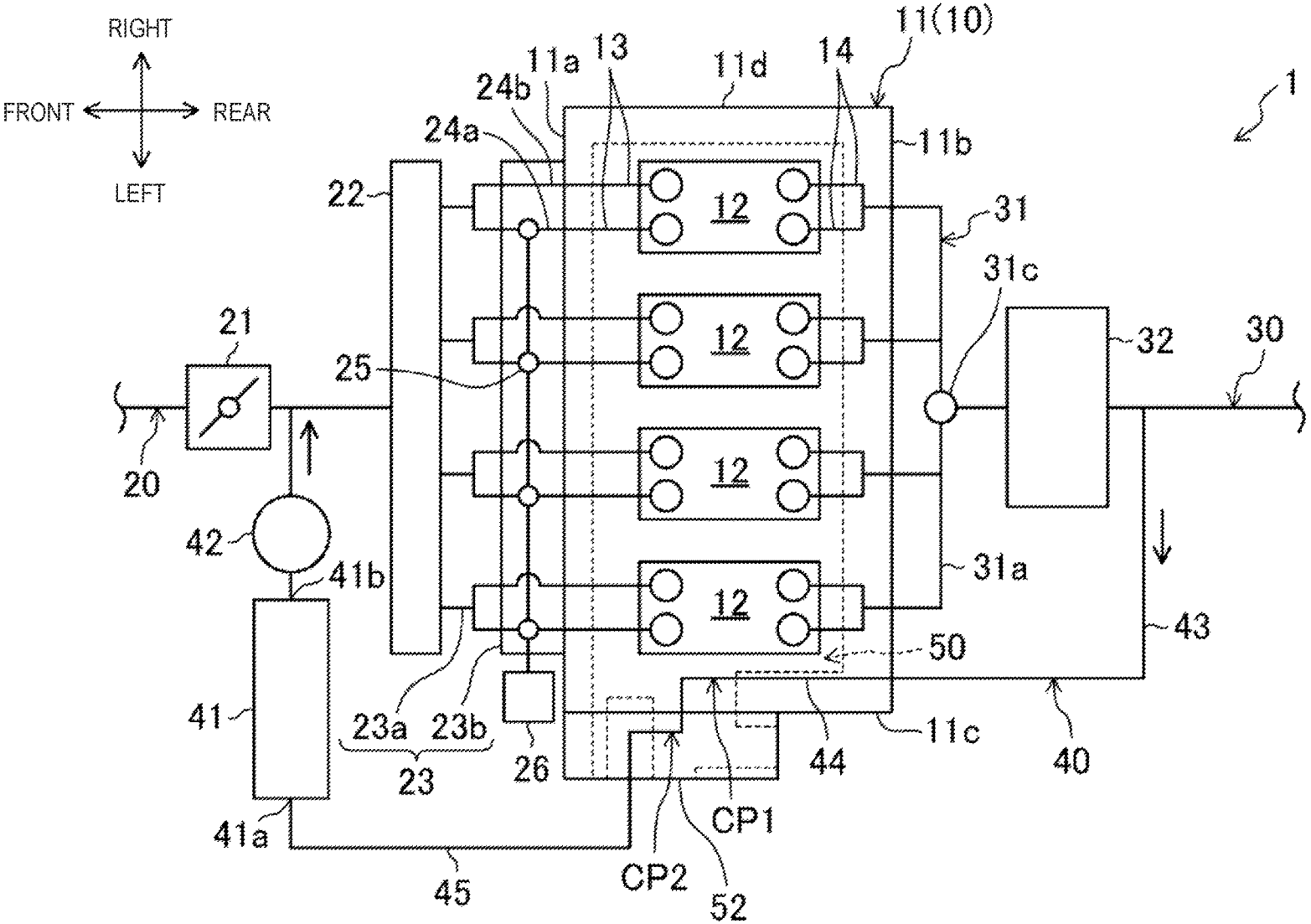
FIG. 1 is a diagram illustrating main devices of an engine.
Figure 2:
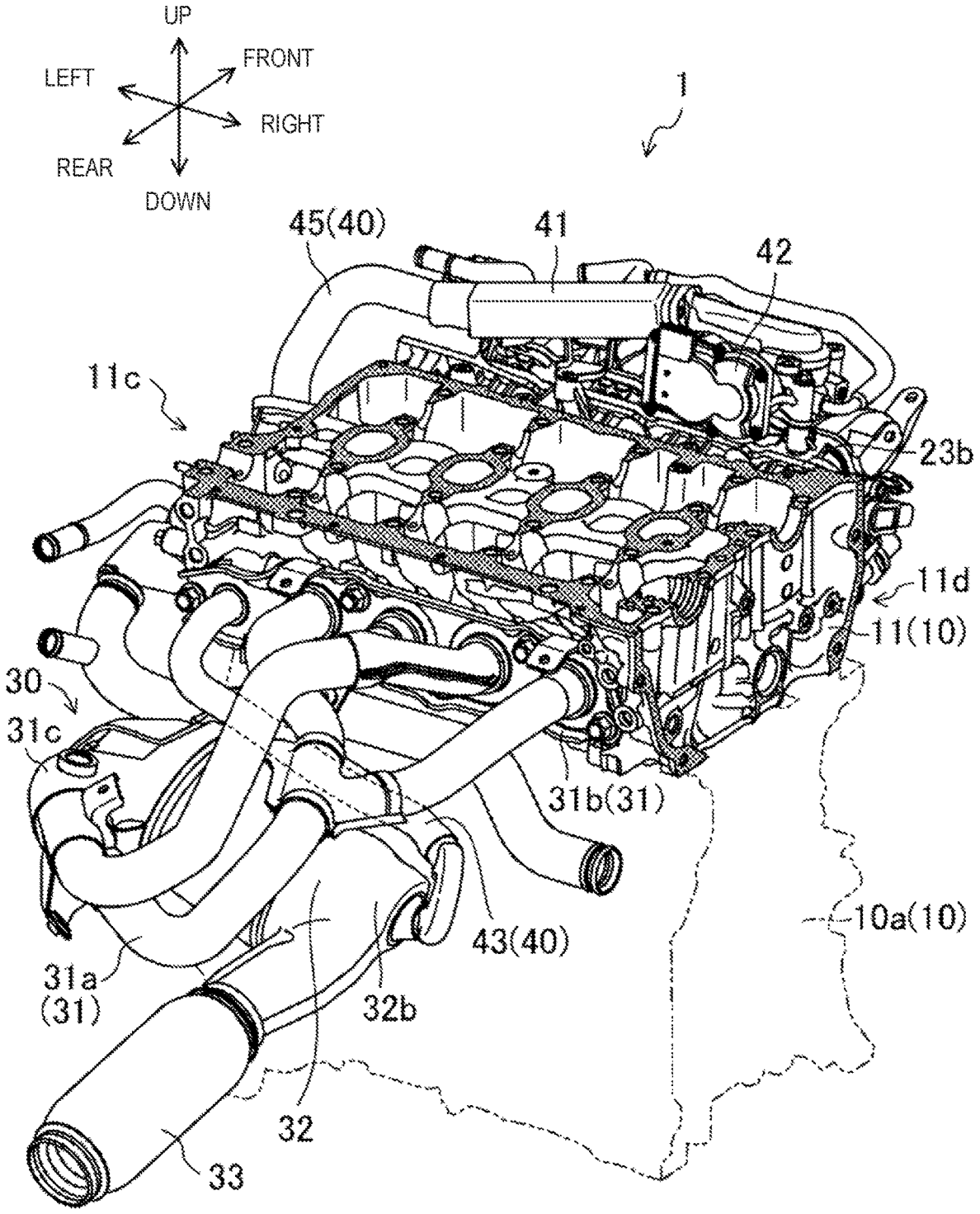
FIG. 2 is a schematic perspective view specifically illustrating an overall structure of the engine.
Figure 3:
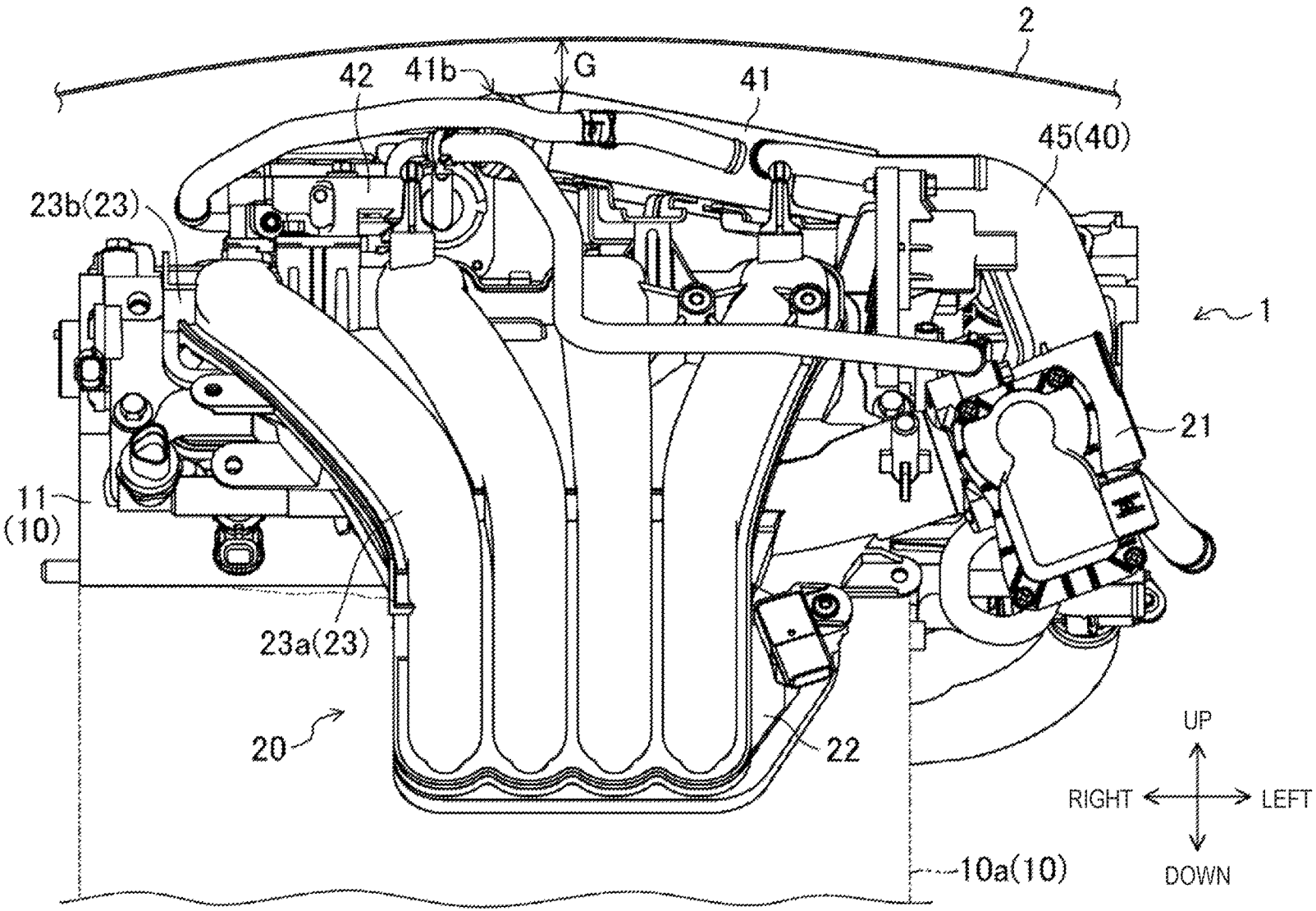
FIG. 3 is a schematic front view of an upper part of the engine.
Figure 4:
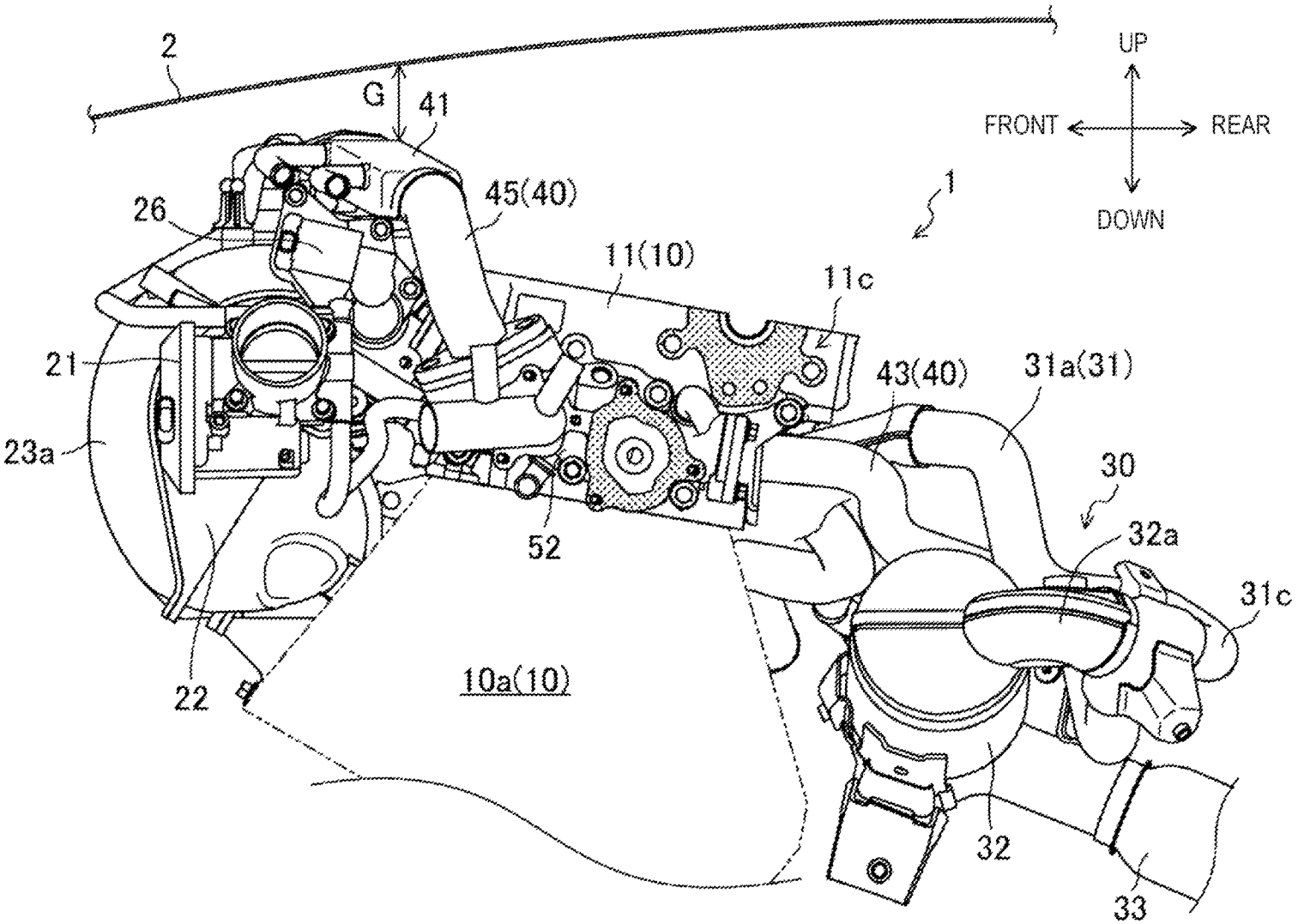
FIG. 4 is a schematic left-side view of the upper part of the engine.
Figure 5:
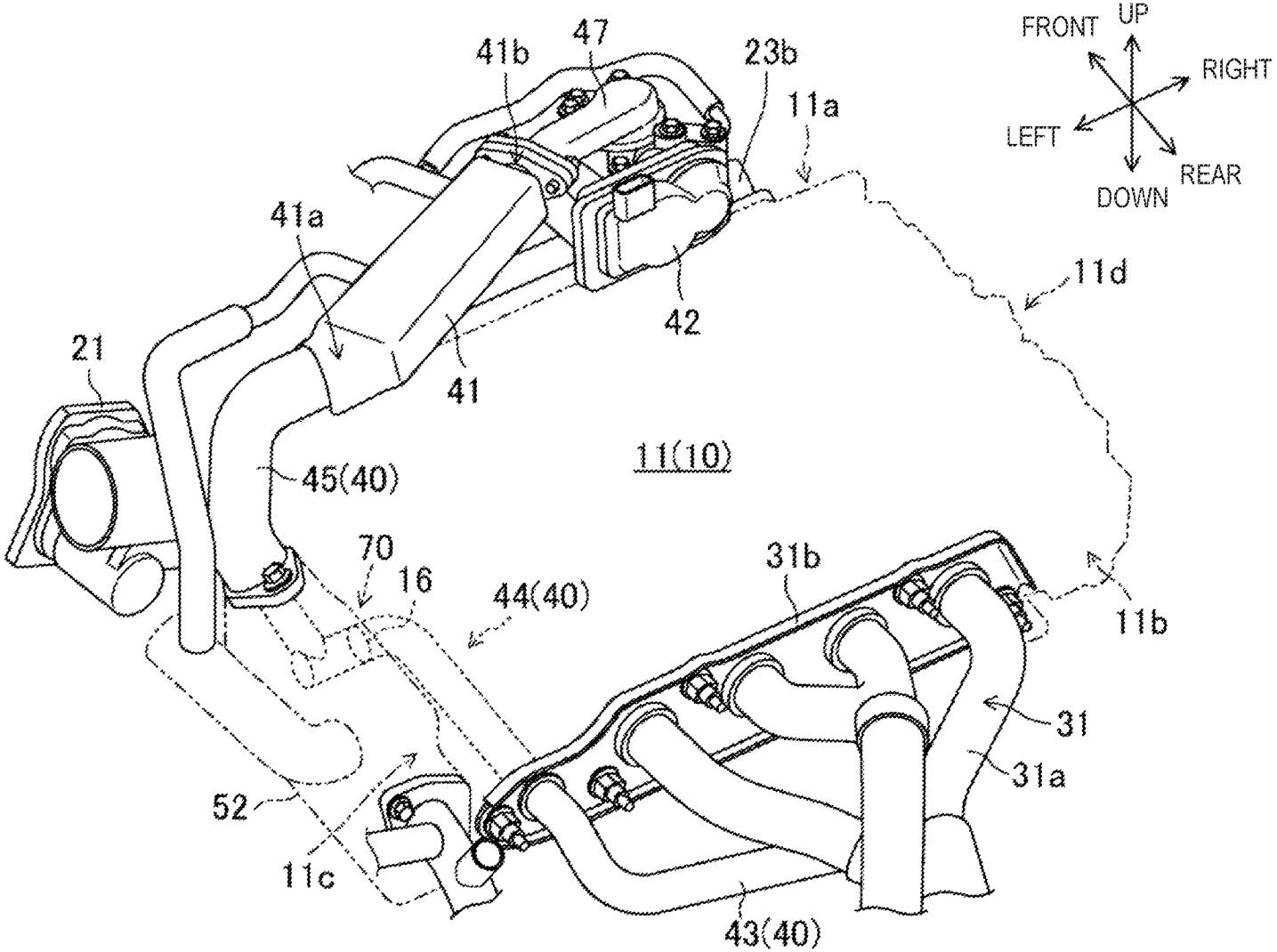
FIG. 5 is a schematic perspective view of the upper part of the engine, seen from an obliquely upper side.
Figure 6:
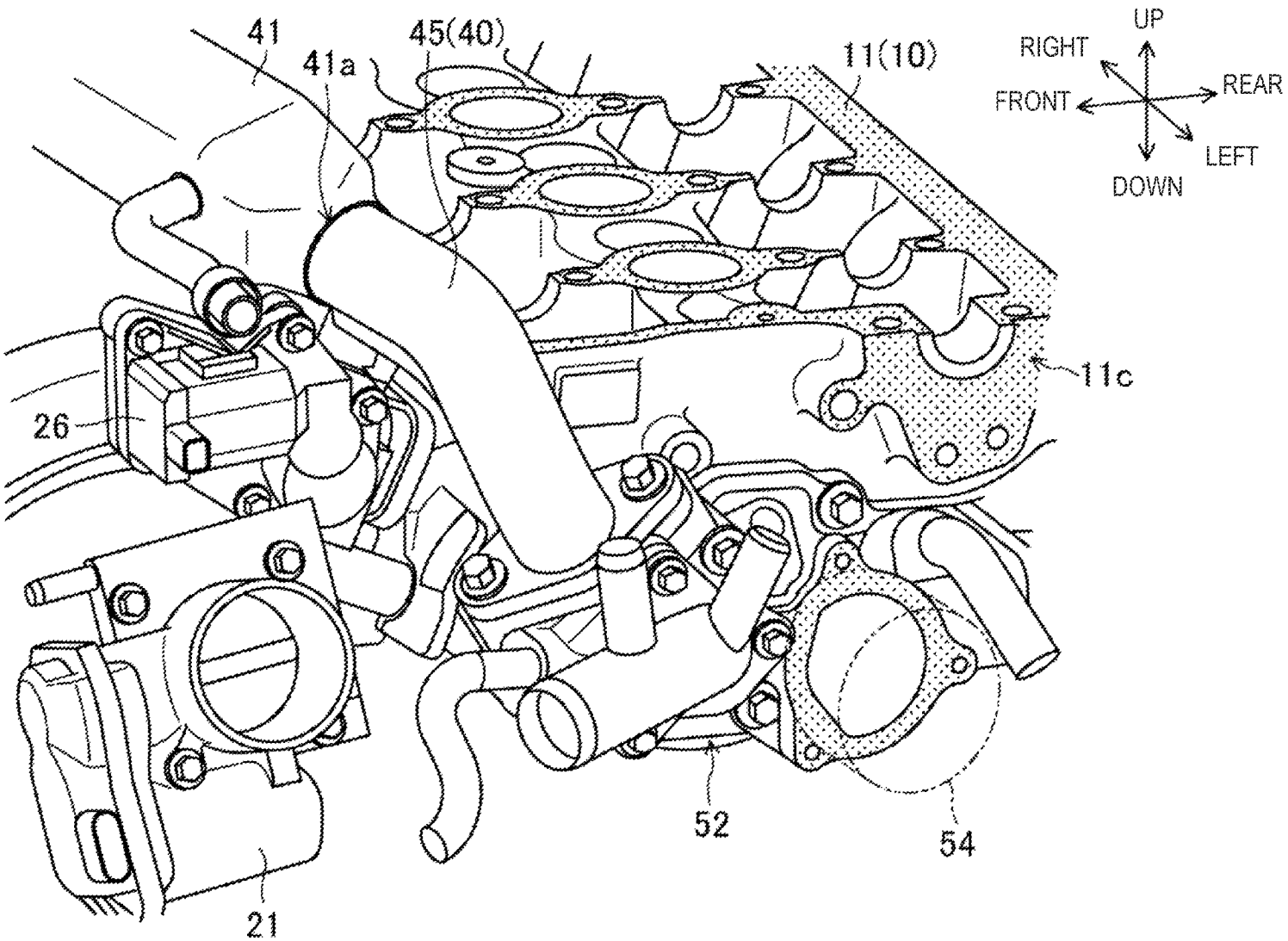
FIG. 6 is a schematic perspective view illustrating a part on a left side of the engine, in an enlarged manner.

FIG. 1 is a diagram illustrating main devices of an exhaust gas recirculation (EGR) system integrally configured with an engine (hereinafter, collectively referred to simply as the "engine 1"). FIG. 2 is a schematic perspective view specifically illustrating an overall structure of the engine 1. FIG. 3 is a schematic front view of an upper part of the engine 1. FIG. 4 is a schematic view of the upper part of the engine 1, seen from a side of a first end surface 11*c* of a cylinder head 11. FIG. 5 is a schematic perspective view of the upper part of the engine 1, seen from an obliquely upper side thereof. FIG. 6 is a schematic perspective view illustrating a part of the engine 1 in an enlarged manner.

Arrows illustrated in the drawings indicate directions of "front and rear," "left and right," and "up and down" used for description. Further, directions of "upstream" and "downstream" used for description are based on a flow direction of target fluid. For the sake of convenience, the illustration of the engine is partially omitted in the drawings.

The engine 1 is installed in a four-wheel automobile, for example in an engine bay of the automobile. As illustrated in FIGS. 3 and 4, the upper part of the engine 1 is covered by a bonnet 2. A gap G between the engine 1 and the bonnet 2 needs to have at least a given size in order for the bonnet 2 to deform at the time of a collision and its impact is mitigated. This engine 1 is reduced in its overall height, including the EGR system, so as to secure the gap G.

The automobile runs by a vehicle driver controlling an operation of the engine 1. The engine 1 combusts a mixture gas containing gasoline in combustion chambers 12 described later. The engine 1 is a four-stroke cycle engine which repeats an intake stroke, a compression stroke, an expansion stroke, and an exhaust stroke.

The engine 1 includes an intake passage 20 which sends intake air to each of the combustion chambers 12, and an exhaust passage 30 which discharges exhaust gas from the combustion chamber 12, in accordance with the combustion cycle. The engine 1 also includes the EGR system described above. That is, the engine 1 performs EGR in which a portion of the exhaust gas discharged to the exhaust passage 30 is recirculated back to the intake passage 20 as EGR gas.

In this engine 1, a circulation amount of the EGR gas is increased larger than a conventional amount to avoid abnormal combustion. Thus, a combustion with a stoichiometric air-fuel ratio as a target value is performed even when the engine 1 operates in a high load range.

Normally when the engine 1 operates in the high load range where a high torque output is required, a combustion temperature rises and abnormal combustion occurs. Therefore, in the high load range, an enrichment control in which a ratio of an air amount with respect to a fuel amount (so-called A/F, air-fuel ratio) is reduced is performed. Latent heat of vaporization of the fuel thus increased is used to cool the mixture gas in order to avoid abnormal combustion. However, in the enrichment control, the fuel amount increases and therefore fuel efficiency degrades.

Meanwhile, performing combustion at the stoichiometric air-fuel ratio, in which the fuel and oxygen combust proportionally, improves fuel efficiency. However, such combustion at the stoichiometric air-fuel ratio cannot utilize the latent heat of vaporization, and abnormal combustion cannot be avoided. If the circulation amount of the EGR gas is increased in this case, an oxygen concentration of the intake air decreases. As a result, a self-ignition timing is delayed and abnormal combustion can be avoided.

This engine 1 performs combustion with the stoichiometric air-fuel ratio as the target value when operating in the high load range. Further, the circulation amount of the EGR gas is increased to avoid abnormal combustion. The high load range referred to here is, for example, a range higher than a given load, including a full engine load, for example a high load range determined by bisecting an operating range of the engine 1 in the load direction. The high load range may be a highest load range determined by dividing the operating range of the engine 1 into three regions in the load direction.

When combusting at the stoichiometric air-fuel ratio, the temperature of the exhaust gas becomes high. Therefore, when the engine 1 operates in the high load range, EGR gas is recirculated in a larger amount and at a higher temperature compared to a conventional example. In this regard, the engine 1, specifically the EGR system thereof, is devised to resolve problems that occur accordingly (details will be described later).

<Engine Body 10>

As illustrated in FIG. 2, the engine 1 includes an engine body 10 comprised of a cylinder block 10*a* and the cylinder head 11. The cylinder head 11 is mounted on the cylinder block 10*a*. The cylinder head 11 constitutes the upper part of the engine body 10, and the cylinder block 10*a* constitutes a lower part of the engine body 10. The engine body 10 is formed with a plurality of combustion chambers 12. As illustrated in FIG. 1, the engine 1 of this example is a so-called four-cylinder engine having four combustion chambers 12.

The four combustion chambers 12 are arranged in line in an extending direction of a non-illustrated crankshaft (output shaft direction). The engine body 10 is longer in the output shaft direction. The engine body 10 is arranged transversely in the engine bay so that its output shaft direction substantially coincides with a vehicle width direction (left-and-right direction).

Therefore, as illustrated in FIG. 1, when the cylinder head 11 is used as a reference, a pair of relatively long side surfaces of the cylinder head 11 face the front-and-rear direction, respectively (front side surface 11*a* and rear side surface 11*b*). The four combustion chambers 12 are arranged in line between left and right end faces (first end surface 11*c* and second end surface 11*d*) of the cylinder head 11. A part of the cylinder head 11 defined by a dotted line indicates a joint surface to which an attachment member is attached in FIG. 2.

Although not illustrated, four cylinders are formed in the cylinder block 10*a*. A reciprocatable piston is provided in each cylinder. A lower surface of each cylinder is closed by the piston. An upper surface of each cylinder is closed by the cylinder head 11. The engine body 10 is partitioned by the cylinder block 10*a*, the pistons, and the cylinder head 11, and thus, the combustion chambers 12 are formed therein.

When the engine 1 is operating, the engine body 10 rises high in temperature. A cooling system which cools with cooling water is attached to the engine 1 to cool the engine body 10. Although not illustrated, the water-cooling system is comprised of a water pump and a radiator. The water-cooling system cools the engine body 10, a heater core for air conditioning, an EGR cooler 41, and an ATF cooler (a cooler which cools oil used in transmission) by exchanging heat with the cooling water.

For example, as illustrated in FIG. 1, a water-cooling passage 50 through which cooling water flows is formed around each of the combustion chambers 12 of the cylinder block 10*a* and the cylinder head 11. By operating a water pump, the cooling water circulates in the water-cooling passage 50.

A water outlet 52 (first attachment member) which distributes a portion of the cooling water flowing through the water-cooling passage 50 to the EGR cooler 41, the ATF cooler, etc. is attached to the first end surface 11*c* of the cylinder head 11. A thermostat 54 (indicated by a two-dotted chain line in FIG. 6) is attached to the water outlet 52. The thermostat 54 switches the channel of the cooling water. Note that although the engine 1 is also provided with a combustion supply system which supplies fuel to each combustion chamber 12, an ignition plug which ignites the mixture gas, a valve operating mechanism, etc., illustration and description thereof are omitted for the sake of convenience.

<Intake Passage 20>

Two intake ports 13 communicating with the combustion chamber 12 are formed in the front side surface 11*a* of the cylinder head 11. Each intake port 13 communicates with the combustion chamber 12 via an openable intake valve. In this engine 1, the intake port 13 is open to the front side surface 11*a* of the cylinder head 11 (total of eight openings). The intake passage 20 is connected to the front side surface 11*a* of the cylinder head 11 so as to communicate with the intake port 13.

As illustrated in FIG. 1, the intake passage 20 is provided with a throttle valve 21, a surge tank 22, and an intake manifold 23. The throttle valve 21 adjusts an amount of air (fresh air) taken into the intake passage 20. As illustrated in FIGS. 3 and 4, the throttle valve 21 is arranged at a position forward and leftward of the upper part of the engine body 10.

The surge tank 22 is a large-volume container and is arranged downstream of the throttle valve 21. As illustrated in FIGS. 3 and 4, the surge tank 22 is integrally formed with the intake manifold 23. The surge tank 22 is arranged near the front side of the engine body 10. The intake manifold 23 has four flow channels communicating with the surge tank 22, and the intake air is distributed to the combustion chambers 12 through these flow channels.

For example, the intake manifold 23 has four intake branch pipes 23*a* and a connecting bracket 23*b*. Each of the intake branch pipes 23*a* extends upward from a lower end of a front surface of the surge tank 22 while curving and branching. The intake branch pipe 23*a* further intersects the front surface of the surge tank 22 and then extends toward the front side surface 11*a* of the cylinder head 11.

As illustrated in FIG. 2, the connecting bracket 23*b* is a transversely long bracket in which the intake branch pipes 23*a* are connected to each other. The connecting bracket 23*b* is attached to the front side surface 11*a* of the cylinder head 11 to extend transversely along the cylinder head 11. As illustrated in FIG. 1, a plurality of branch passages 24*a* and 24*b* are formed inside the connecting bracket 23*b* to communicate the opening of each intake port 13 with a corresponding intake branch pipe 23*a*.

As illustrated in FIG. 1, a downstream end of each intake branch pipe 23*a* branches into two passages. Each of these passages is connected to a pair of branch flow channels (first branch passage 24*a* and second branch passage 24*b*) formed inside the connecting bracket 23*b*.

A swirl control valve 25 is provided in each first branch passage 24*a*. The swirl control valve 25 adjusts an opening of the flow channel of the first branch passage 24*a*. These swirl control valves 25 are collectively driven by a single drive motor 26 (second attachment member) attached to the engine body 10. By controlling the swirl control valve 25, the strength of a swirl flow generated in the combustion chamber 12 changes.

Note that this engine 1 does not perform forced induction. The engine 1 performs intake at atmospheric pressure. This engine 1 is a so-called naturally aspirated engine.

<Exhaust Passage 30>

As illustrated in FIG. 1, two exhaust ports 14 communicating with each combustion chamber 12 are formed on the rear side surface 11*b* of the cylinder head 11. Each exhaust port 14 communicates with the combustion chamber 12 via an openable exhaust valve. In this engine 1, the rear side surface 11*b* of the cylinder head 11 is formed with exits at which the exhaust ports 14 merge (total of four exits). The exhaust passage 30 is connected to the rear side surface 11*b* of the cylinder head 11 to communicate with the exhaust ports 14.

The exhaust passage 30 is provided with an exhaust manifold 31 and an exhaust emission control system 32. As illustrated in FIGS. 2 and 5, the exhaust manifold 31 has a pipe group 31*a* comprised of a plurality of pipes and a connecting bracket 31*b*. The pipe group 31*a* branches into four flow channels communicating with the corresponding exhaust ports 14. The connecting bracket 31*b* is formed by a transversely long plate-shaped bracket.

An upstream end part of the pipe group 31*a* is attached to the connecting bracket 31*b*. The connecting bracket 31*b* is attached to the rear side surface 11*b* of the cylinder head 11 so that each of the pipes constituting the pipe group 31*a* communicates with the exhaust port 14. A downstream end part of the pipe group 31*a* joins into a single flow channel (merging portion 31*c*). The exhaust manifold 31 is connected to a gas introduction part 32*a* of the exhaust emission control system 32 via the merging portion 31*c*.

As illustrated in FIGS. 2 and 4, the exhaust emission control system 32 has a capsule-shaped case. The exhaust emission control system 32 is disposed near a rear end of the engine body 10. The case contains therein a three-way catalyst and a filter. A gas outflow part 32*b* of the exhaust emission control system 32 is connected with a flexible pipe 33 extending rearward. An exhaust pipe (not illustrated) extends outside the engine bay via the flexible pipe 33.

<EGR Passage 40>

As illustrated in FIG. 1, an EGR passage 40 connects the exhaust passage 30 to the intake passage 20. The EGR gas flows through the EGR passage 40 in an arrow direction. For example, an upstream end portion of the EGR passage 40 is connected to a position of the exhaust passage 30 downstream of the exhaust emission control system 32. A downstream end portion of the EGR passage 40 is connected to a position of the intake passage 20 between the throttle valve 21 and the surge tank 22.

The EGR passage 40 is provided with the EGR cooler 41 and an EGR valve 42. The EGR cooler 41 has a gas inflow port 41*a* at its one end and a gas outflow port 41*b* at the other end. The EGR cooler 41 cools the EGR gas (a portion of the exhaust gas) flowing in from the gas inflow port 41*a* and out from the gas outflow port 41*b*. The EGR valve 42 adjusts the flow rate of the EGR gas flowing through the EGR passage 40. The EGR valve 42 is disposed downstream of the EGR cooler 41. The EGR passage 40, the EGR cooler 41, and the EGR valve 42 constitute the "EGR system."

As illustrated in FIGS. 2, 3 and 5, the EGR cooler 41 and the EGR valve 42 are disposed adjacent to each other above the intake manifold 23. As illustrated in FIG. 1, the EGR passage 40 is comprised of an EGR introduction pipe 43, an EGR internal passage 44, and a relay pipe 45 (relay passage).

The EGR introduction pipe 43 constitutes an upstream portion of the EGR passage 40. As illustrated in FIG. 2, an upstream end portion of the EGR introduction pipe 43 is connected to the gas outflow 32*b* of the exhaust emission control system 32. As illustrated in FIGS. 2 and 5, a downstream end portion of the EGR introduction pipe 43 is attached to an end part of the connecting bracket 31*b*. The EGR introduction pipe 43 is attached to the rear side surface 11*b* of the cylinder head 11 via the connecting bracket 31*b*. The EGR introduction pipe 43 extends upwardly in the downstream direction.

The EGR internal passage 44 is a tubular passage formed in the cylinder head 11. The EGR internal passage 44 passes through the cylinder head 11. The EGR introduction pipe 43 communicates with the EGR internal passage 44.

As illustrated in FIG. 1, a passage through which cooling water flows (water-cooling passage 50) is formed inside the cylinder head 11. The EGR internal passage 44 removes the excess heat of the EGR gas flowing inside the water-cooling passage 50 by exchanging heat with the cooling water flowing therein. In this engine 1, by devising the shape and arrangement of the EGR system, the EGR gas is effectively cooled before flowing into the EGR cooler 41 (the EGR internal passage 44 will be described later in detail).

As illustrated in FIGS. 5 and 6, the relay pipe 45 connects to the gas inflow port 41*a* of the EGR cooler 41. The relay pipe 45 extends toward the first end surface 11*c* of the cylinder head 11. The water outlet 52 (described later) is attached to the first end surface 11*c* of the cylinder head 11. An upstream end portion of the relay pipe 45 is connected to the water outlet 52. As a result, the relay pipe 45 constitutes the relay passage connecting the EGR internal passage 44 to the EGR cooler 41, outside the cylinder head 11.

In this engine 1, a layout of the overall EGR system has been reviewed (described later in detail) in order to improve the cooling performance of the EGR gas, as well as securing the gap G between the engine 1 and the bonnet 2 and the drainage property of the EGR cooler 41 transversely arranged on the engine 1.

<EGR Internal Passage 44>

As described above, this engine 1 performs combustion with the stoichiometric air-fuel ratio as the target value when operating in the high load range. Further, the circulation amount of the EGR gas is increased to avoid abnormal combustion. Therefore, the EGR gas flows through the EGR passage 40 in a larger amount and at a higher temperature compared to a conventional example.

As a result, an amount of heat exceeding the cooling performance of the EGR cooler 41 may be added to the EGR cooler 41 and the durability of the EGR cooler 41 may degrade. On the other hand, in this engine 1, by devising the shape and arrangement of the EGR internal passage 44, the EGR gas flowing into the EGR cooler 41 is effectively cooled and the excess heat thereof is removed.

In detail, the EGR internal passage 44 is not only formed inside the cylinder head 11 but also inside the water outlet 52.

As illustrated in FIGS. 1 and 5, an upstream end portion of the EGR internal passage 44 is open to the left side of the rear side surface 11*b* of the cylinder head 11 (near the first end surface 11*c*). The upstream end portion of the EGR internal passage 44 is connected to the EGR introduction pipe 43. The upstream portion of the EGR internal passage 44 extends inside the cylinder head 11 toward the front side surface 11*a* along the first end surface 11*c*. The upstream portion of the EGR internal passage 44 extends substantially horizontal.

Further as illustrated in FIG. 1, the upstream portion of the EGR internal passage 44 is arranged so that a part thereof intersects the water-cooling passage 50 therein (first cooling portion CP1). In the first cooling portion CP1, the EGR gas flowing in the EGR internal passage 44 is indirectly in contact with the cooling water flowing in the water-cooling passage 50 via a thin pipe wall. Therefore, heat is exchanged efficiently and the EGR gas is effectively cooled.

Further, a bent pipe part 70 is provided in a downstream portion of the EGR internal passage 44 connected to the first cooling portion CP1. As illustrated in FIG. 5, the bent pipe part 70 is arranged over both the cylinder head 11 and the water outlet 52. Further, the water-cooling passage 50 is arranged around the bent pipe part 70. The EGR gas flowing through the bent pipe part 70 collides with a wall surface thereof. The flow of EGR gas stagnates at the bent pipe part 70.

As a result, heat dissipation of the EGR gas in the bent pipe part 70 improves. Further, the water-cooling passage 50 is disposed around the bent pipe part 70. Therefore, the heat exchange between the EGR gas and the cooling water is promoted. That is, the EGR gas is effectively cooled (second cooling portion CP2 illustrated in FIG. 1). The excess heat of the EGR gas is effectively removed by the combination of the bent pipe part 70 and the water-cooling passage 50. Therefore, the durability of the EGR cooler 41 and the cooling performance of the EGR gas improve.

<Layout of EGR System>

As described above, in this engine 1, a larger amount of EGR gas than a conventional example is recirculated. In order to smoothly recirculate a large amount of EGR gas, it is necessary to expand the channel cross section of the EGR passage 40 and reduce a channel resistance. Therefore, it is necessary to secure more space around the engine body 10 in the engine bay where the space is limited.

Further, as described above, the gap G of a given size needs to be secured between the engine 1 and the bonnet 2. Therefore, when the EGR cooler 41 is placed transversely above the intake manifold 23, it is necessary to reduce the height thereof.

As the recirculation flow rate of the EGR gas increases, condensed water generated by the EGR cooler 41 also accordingly increases. Therefore, when the EGR cooler 41 is placed transversely, it is necessary to improve its drainage property.

Therefore, in this engine 1, the layout of the entire EGR system is reviewed and devised to collectively resolve such challenges.

(EGR Cooler 41, Relay Pipe 45)

Figure 7:
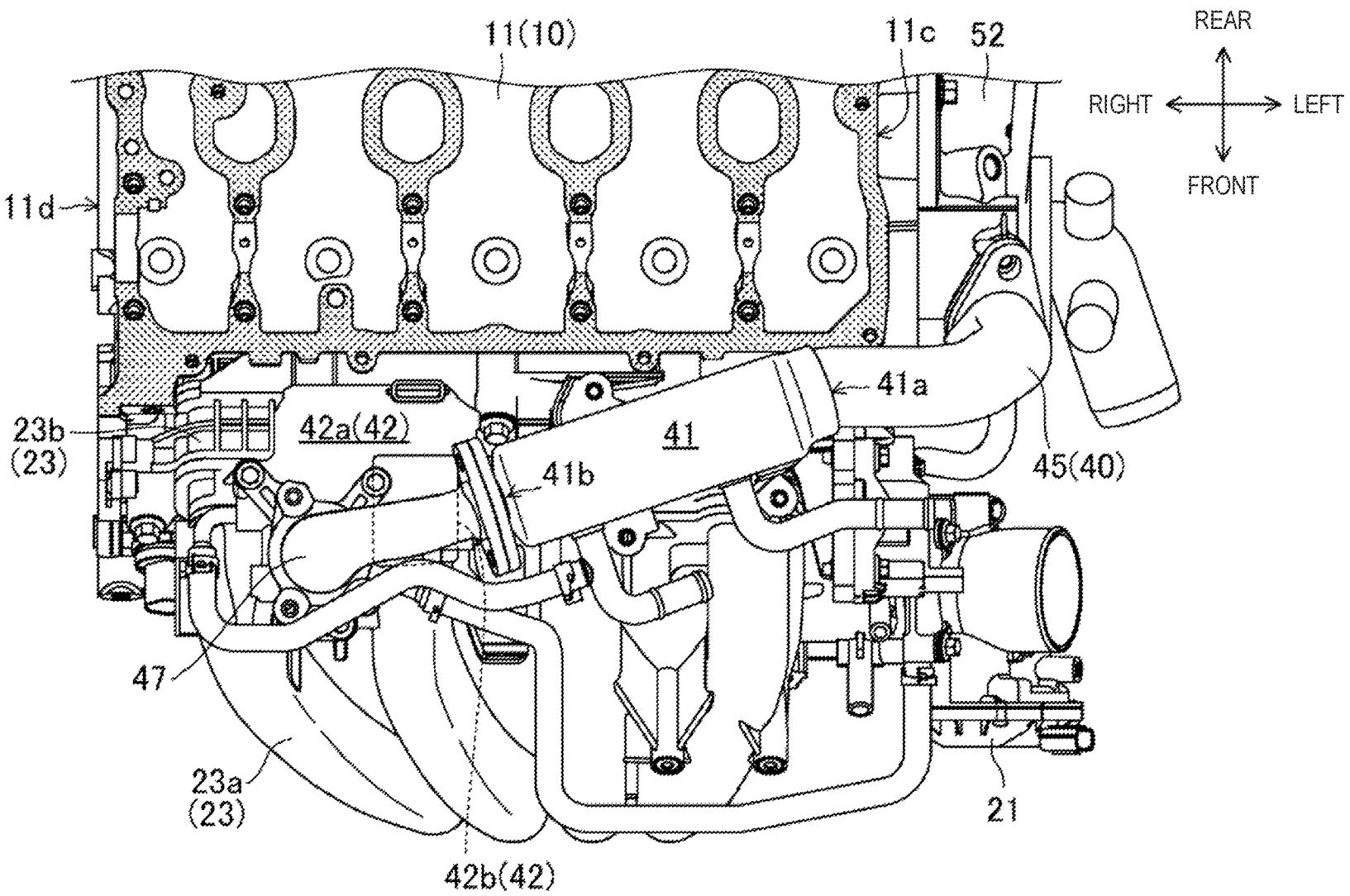
FIG. 7 is a schematic upper view of an upper front part of the engine.

The EGR cooler 41 is transversely long and flat in shape. As illustrated in FIGS. 5 and 7, the EGR cooler 41 has a transversely long shape in which a distance from the gas inflow port 41*a* to the gas outflow port 41*b* is long. Further, the EGR cooler 41 has a flat columnar shape in which a horizontal width is larger than a vertical width of the channel cross section. Therefore, the height of the EGR cooler 41 is reduced by narrowing the vertical width. The entire length is extended and thus the cooling performance is secured.

Here, the columnar shape may be a rectangular solid or a cylindrical shape. Further, although a surface of the EGR cooler 41 is provided with a pipe which allows cooling water to enter and exit, and unevenness for the purpose of ensuring rigidity, the columnar shape referred to here includes such distorted shapes.

The EGR cooler 41 is located above the intake manifold 23 so that the gas inflow port 41*a* is located on the side of the first end surface 11*c* and the gas outflow port 41*b* is located on the second end surface 11*d* side. That is, the EGR cooler 41 is arranged so as to extend in the longitudinal direction of the cylinder head 11 in a state where its orientation is matched with the direction in which the EGR gas flows (gas flow direction). Thereby, the smooth inflow and outflow of the EGR gas are ensured, and the height of the EGR cooler is reduced so as to be within the entire length range of the cylinder head 11.

As illustrated in FIGS. 5 and 7, the relay pipe 45 is connected to communicate with the EGR internal passage 44 on the side of the first end surface 11*c* of the cylinder head 11. For example, the relay pipe 45 is connected to the water outlet 52 attached to the first end surface 11*c* thereof.

As described above, the downstream portion of the EGR internal passage 44 including the bent pipe part 70 is formed inside the water outlet 52. The downstream portion of the EGR internal passage 44 is located further outwardly from the first end surface 11*c* and constitutes an extension passage.

That is, the first end surface 11*c* is formed with an exit through which the EGR gas flows out from the cylinder head 11 (head EGR gas exit 16). The EGR gas that passed through the inside of the cylinder head 11 flows into the water outlet 52 through the head EGR gas exit 16. The downstream portion of the EGR internal passage 44, including the bent pipe part 70, is formed inside the cylinder head 11 and the water outlet 52 via the head EGR gas exit 16.

The relay pipe 45 is connected at a position further laterally away from the first end surface 11*c* of the cylinder head 11. That is, the relay pipe 45 communicates with the EGR internal passage 44 on further outwardly from the head EGR gas exit 16. By connecting the relay pipe 45 at a position externally away from the first end surface 11*c*, a distance to the EGR cooler 41 increases, and the relay pipe 45 is extended.

Further, as illustrated in FIG. 3, the EGR cooler 41 is gently inclined downward from the gas outflow port 41*b* toward the gas inflow port 41*a*. In the vehicle width direction, the gas outflow port 41*b* is located substantially in the center of the engine bay, and the gas inflow port 41*a* is located on the left side of the engine bay. Then, the EGR cooler 41 is arranged so as to gently incline downward from the right side to the left side.

Since the EGR cooler 41 has a flat shape as described above, it may be tilted with reduced height. Since the EGR cooler 41 is long in the gas flow direction, the condensed water generated by the EGR cooler 41 smoothly flows to the upstream side even if the inclination is gentle. In addition, the condensed water is prevented from entering the downstream side where the EGR valve 42 is located.

Normally, the bonnet 2 has an upwardly bulging shape as illustrated in FIG. 3. Therefore, the bonnet 2 is higher in an intermediate part in the vehicle width direction. By inclining the EGR cooler 41 in this manner, the EGR cooler 41 is arranged along the shape of the bonnet 2. Therefore, it becomes easy to secure the gap G between the EGR cooler 41 and the bonnet 2.

As illustrated in FIGS. 3 and 6, the relay pipe 45 is connected to the gas inflow port 41*a* in a bent state so that it is positioned lower as it extends upstream.

A large amount of EGR gas flows through the EGR passage 40. Therefore, the channel cross section of the relay pipe 45 is desirably large, and the channel resistance of the relay pipe 45 is desirably small. Therefore, it is desirably that the relay pipe 45 is constituted by a pipe having a large diameter and bent in the flow direction of gas, and the relay pipe 45 is smoothly connected to the gas inflow port 41*a* and the water outlet 52.

By inclining the EGR cooler 41, the condensed water flows down to the relay pipe 45. Therefore, even in the relay pipe 45, the condensed water needs to flow smoothly to the upstream side. Therefore, the relay pipe 45 also needs to be lowered toward the upstream side. Then, in order to smoothly connect to the gas inflow port 41*a*, the downstream portion of the relay pipe 45 needs to be inclined at an angle similar to that of the EGR cooler 41. Similarly, the upstream portion of the relay pipe 45 needs to be smoothly connected to the water outlet 52.

However, when the diameter becomes large, a degree of bend cannot be large and a radius of curvature becomes large. In this regard, in this engine 1, the relay pipe 45 is connected at a position outwardly separated from the first end surface 11*c* of the cylinder head 11. Therefore, the distance to the gas inflow port 41*a* becomes long.

As a result, the entire length of the relay pipe 45 becomes long, and the relay pipe 45 having a large pipe diameter and a large radius of curvature is structured. The relay pipe 45 is smoothly connected to each of the gas inflow port 41*a* and the water outlet 52. As a result, a large amount of EGR gas smoothly flows, and condensed water is smoothly discharged. By bending the relay pipe 45, its outward projection amount from the first end surface 11*c* of the cylinder head 11 is also reduced. Therefore, there is no need to secure a large installation space in the engine bay.

Further, the EGR cooler 41 is also arranged to incline in a lateral direction. For example, as illustrated in FIG. 7, the EGR cooler 41 is arranged to incline toward one of the front-rear direction so that the gas outflow port 41*b* is located away from the cylinder head 11 than the gas inflow port 41*a* when seen vertically.

Accordingly, the relay passage is also arranged to incline in a vertical direction as illustrated in FIG. 4. For example, the relay passage is arranged to incline to one of the up-and-down direction so that the upstream side is located away from the gas inflow port 41*a* than the downstream side, when seen in the left-and-right direction. Thus, the EGR cooler 41 and the relay pipe 45 become even longer. Therefore, while having an efficient arrangement in a compact space, a smooth flow of EGR gas and a smooth discharge of condensed water are achieved.

Furthermore, a layout of a downstream part of the EGR cooler 41 in the EGR passage 40 is also devised.

Figure 8:
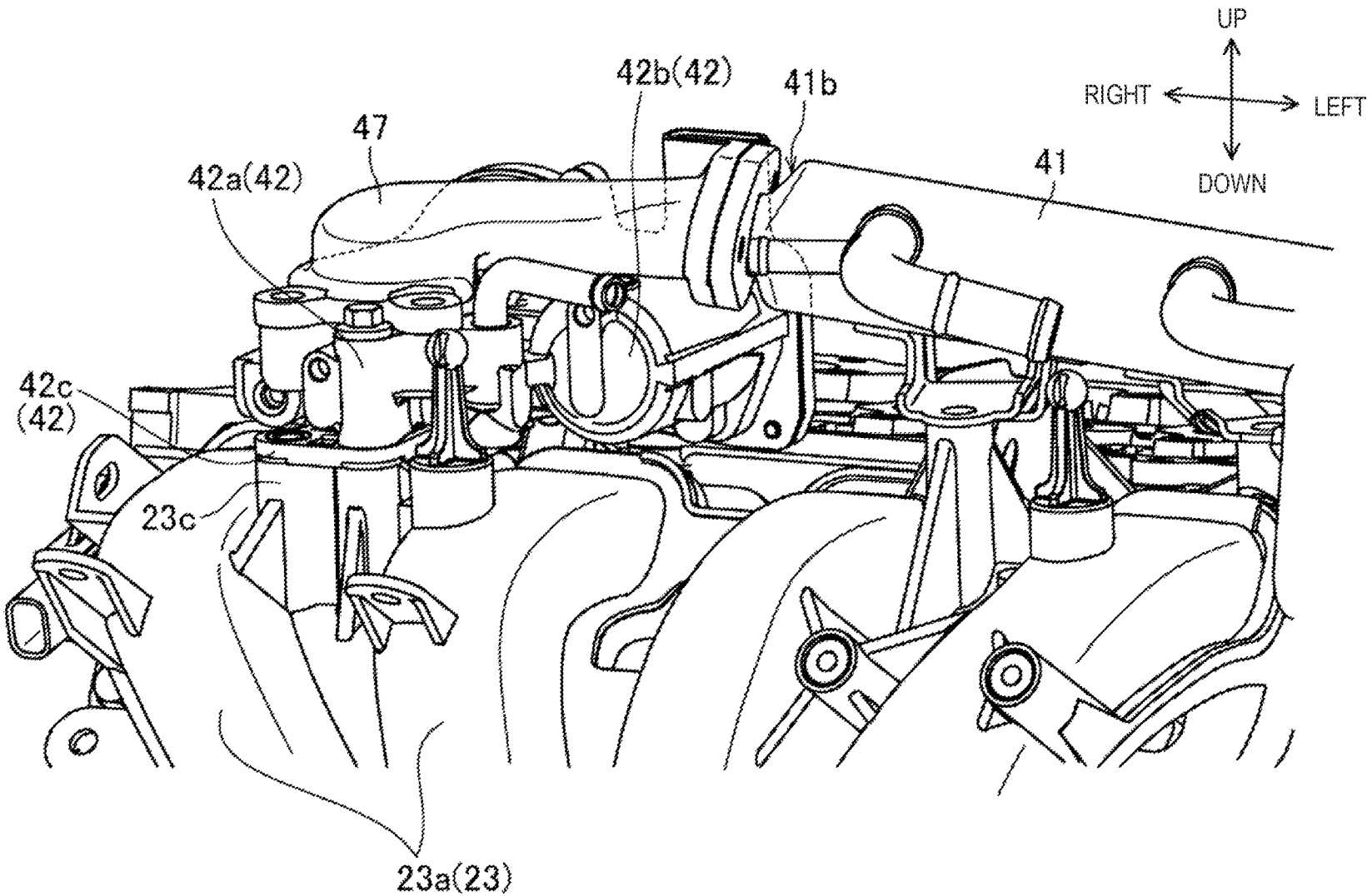
FIG. 8 is a schematic perspective view illustrating a part of the upper front part of the engine, in an enlarged manner.

For example, as illustrated in FIGS. 2, 7, and 8, the EGR valve 42 is directly fixed to the upper part of the intake manifold 23. Specifically, the EGR valve 42 is comprised of a valve body 42*a*, and a valve drive motor 42*b*. The valve drive motor 42*b* is integrated with the valve body 42*a* by being assembled thereto.

Although not illustrated, a gas flow channel through which the EGR gas flows and a valve body which adjusts an opening degree of the gas flow channel are provided inside the valve body 42*a*. The gas flow channel extends in the up-and-down direction. The valve drive motor 42*b* drives the valve body according to a control thereof to adjust the opening degree of the gas flow channel. A flange part 42*c* is provided to the outside of the valve body 42*a* to protrude from a circumference thereof.

As illustrated in FIG. 8, an attaching bracket 23*c* is provided to the upper part of the intake manifold 23, specifically between two intake branch pipes 23*a* located on the right side of the upper part. The flange part 42*c* is fastened to the attaching bracket 23*c* by a plurality of bolts to fix the EGR valve 42 directly to the upper part of the intake manifold 23.

By directly fixing the EGR valve 42 to the intake manifold 23, the supporting strength of the EGR valve 42 increases and a swaying movement of the EGR valve 42 is reduced. The height of the EGR valve 42 is also reduced.

Further, as illustrated in FIGS. 5, 7, and 8, a connecting pipe 47 (connecting passage) is connected to the gas outflow port 41*b* of the EGR cooler 41. The connecting pipe 47 passes the upper side of the EGR 42 and extends toward the second end surface 11*d*, and is connected to the upper part of the EGR valve 42.

The connecting pipe 47 is long in the gas flow direction. Further, the connecting pipe 47 has a flat shape of which a channel cross section is laterally longer than vertically. As illustrated in FIGS. 3 and 8, the connecting pipe 47 is arranged to incline so that its upstream side is higher than the downstream side. Therefore, the condensed water flows to the gas channel of the EGR valve 42 through the connecting pipe 47 even after passing the EGR cooler 41, without accumulating.

Further, similar to the EGR cooler 41, the connecting pipe 47 is arranged along the shape of the bonnet 2. Therefore, it also becomes easy to secure the gap G between the connecting pipe 47 and the bonnet 2.

The connecting pipe 47 passes the upper side of the EGR valve 42 (specifically, the valve drive motor 42*b*) and extends toward the second end surface 11*d*. Therefore, even with the connecting pipe 47 of the laterally long shape, the connecting pipe 47 is arrangeable without projecting outwardly from the second end surface 11*d* of the cylinder head 11. As a result, the entire engine 1 including the EGR system is efficiently disposed in the engine bay.

As described above, the connecting bracket 23*b* of the intake manifold 23 is provided with the plurality of swirl control valves 25. Further, the drive motor 26 which drives the swirl control valves 25 is attached to the engine body 10. The drive motor 26 needs to be disposed near the connecting bracket 23*b* due to its structural property.

In this regard, in this engine 1, the upstream portion of the EGR passage 40 including the EGR cooler 41 and the relay pipe 45 is arranged to pass the upper side of the intake manifold 23 and extend toward the first end surface 11*c* of the cylinder head 11. In such a case, a certain size of space is created below the EGR cooler 41 and the relay pipe 45.

As illustrated in FIGS. 4 and 6, the drive motor 26 is disposed in this space. Therefore, the drive motor 26 is effectively disposed in a space efficient manner. Thus, a dead space is not created.

Thus, since the EGR passage 40 of this engine 1 is formed with the EGR internal passage 44 devised in structure and arrangement, the excess heat of the EGR gas is effectively removed. As a result, the durability of the EGR cooler 41 and the cooling performance of the EGR gas improve.

Moreover, since the entire layout of the EGR system is devised, a large amount of EGR gas is smoothly recirculated and the condensed water generated by the EGR cooler 41 is smoothly discharged. Furthermore, since the overall height of the engine 1 is reduced, the gap G of a given size is also secured between the engine 1 and the bonnet 2.

Thus, in this engine 1, the EGR gas is recirculated in a larger amount at a higher temperature compared to a conventional example. As a result, when the engine operates in the high load range, even if the combustion is performed with the stoichiometric air-fuel ratio as the target value, the circulation amount of the EGR gas is increased to avoid abnormal combustion. Therefore, the EGR system of this engine 1 is improved in fuel efficiency.

Note that the EGR system of the engine according to the present disclosure is not limited to the above embodiment and includes various other configurations. For example, although the gasoline engine is illustrated in the above embodiment, the present disclosure is applicable to a diesel engine. Moreover, although the naturally aspirated engine is illustrated, the present disclosure is applicable to an engine with a forced induction system.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine
2 Bonnet
10 Engine Body
10*a* Cylinder Block
11 Cylinder Head
11*a* Front Side Surface
11*b* Rear Side Surface
11*c* First End Surface
11*d* Second End Surface
12 Combustion Chamber
16 Head EGR Gas Exit
20 Intake Passage
21 Throttle Valve
22 Surge Tank
23 Intake Manifold
30 Exhaust Passage
31 Exhaust Manifold
32 Exhaust Emission Control System

40 EGR Passage
41 EGR Cooler
41*a* Gas Inflow Port
41*b* Gas Outflow Port
42 EGR Valve
45 Relay Pipe (Relay Passage)
47 Connecting Pipe (Connecting Passage)
70 Bent Pipe Part

What is claimed is:

1. An exhaust gas recirculation (EGR) system of an engine, comprising:

an engine body including:

a cylinder head provided in an upper part of the engine body and forming a plurality of combustion chambers in which combustion is performed, a first end surface, and a second end surface, the plurality of combustion chambers being lined up between the first end surface and the second end surface;

an intake passage configured to introduce intake air into each of the plurality of combustion chambers via an intake manifold attached to the cylinder head;

an exhaust passage connected to the cylinder head and through which exhaust gas is discharged from the combustion chambers; and an EGR passage connecting the exhaust passage to the intake passage and configured to recirculate the exhaust gas as EGR gas to the intake passage, the EGR passage including:

an EGR cooler configured to cool the EGR gas while the EGR gas flows from a gas inflow port to a gas outflow port;

an EGR internal passage passing through the cylinder head, on an upstream side of the EGR cooler; and a relay passage extending outside the cylinder head and connecting the EGR internal passage to the EGR cooler, wherein the cylinder head is formed in the first end surface with a head EGR gas exit from which the EGR gas is discharged after passing through the cylinder head, wherein the EGR cooler is formed in a columnar shape having the gas inflow port at one end side in a longitudinal direction and the gas outflow port at the other end side in the longitudinal direction, and is arranged above the intake manifold so as to locate the gas inflow port on the first end surface side and the gas outflow port on the second end surface side, the relay passage communicating with the EGR internal passage, on an external side of the engine compared to the head EGR gas exit, and wherein the EGR cooler inclines downward from the gas outflow port toward the gas inflow port, and the relay passage is connected to the gas inflow port while being bent downward toward the upstream side.

2. The EGR system of claim 1, further comprising a first attachment member attached to the first end surface, the first attachment member including an extension passage located on the external side of the engine compared to the first end surface and constituting the EGR internal passage, wherein the relay passage is connected to the first attachment member to communicate with the extension passage.

3. The EGR system of claim 2, wherein the EGR passage further includes an EGR valve configured to adjust a flow rate of the EGR gas, wherein the EGR valve is disposed downstream of the EGR cooler via a connecting passage connected to the gas outflow port, and wherein the EGR valve is directly fixed to an upper part of the intake manifold, and the connecting passage passes the upper side of the EGR valve, extends toward the second end surface, and is connected to an upper part of the EGR valve.

4. The EGR system of claim 3, wherein the EGR cooler is arranged to incline in a lateral direction and the relay passage is arranged to incline in a vertical direction so that the gas outflow port is located away from the cylinder head compared to the gas inflow port.

5. The EGR system of claim 4, further comprising a second attachment member disposed near the first end surface of the cylinder head, the second attachment member being disposed in a space formed below the EGR cooler and the relay passage.

6. The EGR system of claim 5, wherein when the engine operates in a high load range including a full load, the engine performs combustion with a stoichiometric air-fuel ratio as a target value.

7. The EGR system of claim 1, wherein the EGR passage further includes an EGR valve configured to adjust a flow rate of the EGR gas, wherein the EGR valve is disposed downstream of the EGR cooler via a connecting passage connected to the gas outflow port, and wherein the EGR valve is directly fixed to the upper part of the intake manifold, and the connecting passage passes the upper side of the EGR valve, extends toward the second end surface, and is connected to an upper part of the EGR valve.

8. The EGR system of claim 1, wherein the EGR cooler is arranged to incline in a lateral direction and the relay passage is arranged to incline in a vertical direction so that the gas outflow port is located away from the cylinder head compared to the gas inflow port.

9. The EGR system of claim 1, further comprising a second attachment member disposed near the first end surface of the cylinder head, the second attachment member being disposed in a space formed below the EGR cooler and the relay passage.

10. The EGR system of claim 1, wherein when the engine operates in a high load range including a full load, the engine performs combustion with a stoichiometric air-fuel ratio as a target value.

11. The EGR system of claim 2, wherein the EGR cooler is arranged to incline in a lateral direction and the relay passage is arranged to incline in a vertical direction so that the gas outflow port is located away from the cylinder head compared to the gas inflow port.

12. The EGR system of claim 2, further comprising a second attachment member disposed near the first end surface of the cylinder head, the second attachment member being disposed in a space formed below the EGR cooler and the relay passage.

13. The EGR system of claim 2, wherein when the engine operates in a high load range including a full load, the engine performs combustion with a stoichiometric air-fuel ratio as a target value.

14. The EGR system of claim 3, further comprising a second attachment member disposed near the first end surface of the cylinder head, the second attachment member being disposed in a space formed below the EGR cooler and the relay passage.

15. The EGR system of claim 3, wherein when the engine operates in a high load range including a full load, the engine performs combustion with a stoichiometric air-fuel ratio as a target value.

16. The EGR system of claim 4, wherein when the engine operates in a high load range including a full load, the engine performs combustion with a stoichiometric air-fuel ratio as a target value.

17. The EGR system of claim 7, wherein the EGR cooler is arranged to incline in a lateral direction and the relay passage is arranged to incline in a vertical direction so that the gas outflow port is located away from the cylinder head compared to the gas inflow port.

18. The EGR system of claim 8, further comprising a second attachment member disposed near the first end surface of the cylinder head, the second attachment member being disposed in a space formed below the EGR cooler and the relay passage.

19. The EGR system of claim 11, further comprising a second attachment member disposed near the first end surface of the cylinder head, the second attachment member being disposed in a space formed below the EGR cooler and the relay passage.

20. The EGR system of claim 12, wherein when the engine operates in a high load range including a full load, the engine performs combustion with a stoichiometric air-fuel ratio as a target value.

* * * * *